US008200138B2

(12) United States Patent
Yamamoto et al.

(10) Patent No.: US 8,200,138 B2
(45) Date of Patent: Jun. 12, 2012

(54) PRESSER MEMBER, FIXING DEVICE AND IMAGE FORMING APPARATUS

(75) Inventors: Naoki Yamamoto, Toyohashi (JP); Kazunori Nishinoue, Toyohashi (JP); Satoru Yoneda, Toyohashi (JP); Taizou Oonishi, Hachioji (JP); Hideaki Hayashi, Toyokawa (JP); Norikazu Okabe, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 297 days.

(21) Appl. No.: 12/709,583

(22) Filed: Feb. 22, 2010

(65) Prior Publication Data

US 2010/0215416 A1 Aug. 26, 2010

(30) Foreign Application Priority Data

Feb. 23, 2009 (JP) ..... 2009-039679

(51) Int. Cl.
*G03G 15/20* (2006.01)

(52) U.S. Cl. ..... 399/329

(58) Field of Classification Search ..... 399/329, 399/122

See application file for complete search history.

(56) References Cited

U.S. PATENT DOCUMENTS

2010/0303526 A1* 12/2010 Hayase ..... 399/329

FOREIGN PATENT DOCUMENTS

| | | |
|---|---|---|
| JP | 8-137310 A | 5/1996 |
| JP | 2002-372887 | 12/2002 |
| JP | 2005-4126 A | 1/2005 |
| JP | 2006-058527 | 3/2006 |

OTHER PUBLICATIONS

Office Action (Preliminary Notice of Rejection) dated Feb. 1, 2011, issued in the corresponding Japanese Patent Application No. 2009-039679, and an English Translation thereof.

* cited by examiner

*Primary Examiner* — David Gray
*Assistant Examiner* — Laura Roth
(74) *Attorney, Agent, or Firm* — Buchanan Ingersoll & Rooney PC

(57) ABSTRACT

A first pad has a first nip forming surface which extends in a direction X. An angle formed between an end portion of the first nip forming surface and an XZ plane is smaller than an angle formed between a central portion of the first nip forming surface and the XZ plane, where the XZ plane is formed on a downstream side of the first nip forming surface. Thereby, a fixing device is provided which suppresses generation of wrinkles on a recording material when the fixing device fixes toner on the recording material and conveys it.

6 Claims, 6 Drawing Sheets

PRESSER MEMBER, FIXING DEVICE AND IMAGE FORMING APPARATUS

CROSS-REFERENCE TO RELATED APPLICATION

This application is based on application No. 2009-039679 filed in Japan, the entire content of which is hereby incorporated by reference.

TECHNICAL FIELD

The present invention relates to a presser member of a fixing device used in, for example, copying machines, laser printers, facsimile or the like, and relates to a fixing device with use of the presser member, and an image forming apparatus with use of the fixing device.

BACKGROUND ART

As one of conventional fixing devices, a fixing device is provided with a heating roller, a pressure belt contacting the heating roller, and a presser member placed inside the pressure belt so as to press an inner surface of the pressure belt toward the heating roller (JP 2005-004126 A).

The presser member has a first pad and a second pad which has higher hardness than the first pad. The first pad is placed on an upstream side of the second pad in a rotation direction of the pressure belt on a contact surface between the heating roller and the pressure belt.

In relation to width of the first pat in a rotational direction of the heating roller, circumferential widths of end sections of the first pat in an axial direction thereof are each larger than a circumferential width of a central section of the first pad in the axial direction thereof.

SUMMARY OF INVENTION

In the above-stated conventional fixing device, however, the first pat has the circumferential widths of axial end sections each larger than the circumferential width of the axially central section, and therefore a pressure allocation of the axial end section of the first pad becomes larger than a pressure allocation of the axially central section of the first pad. On the other hand, a pressure allocation of the axial end section of the second pad becomes smaller than a pressure allocation of the axially central section of the second pad.

As the result, in relation to the distortion amount (elastic deformation amount) of the heating roller caused by pressing force of the second pad, the distortion amount of the axial end section of the heating roller becomes smaller than the distortion amount of the axially central section of the heating roller. Thereby, a circumferential velocity of the axial end section of the heating roller becomes slower than a circumferential velocity of the axially central section of the heating roller. Therefore, a feed rate of a recording material by the axial end section of the heating roller becomes slower than the feed rate of the recording material by the axially central section of the heating roller.

This has caused generation of wrinkles on a recording material when the fixing device fixes toner on the recording material while conveying it.

Accordingly, an object of the present invention is to provide a fixing device which suppresses generating of wrinkles on a recording material the fixing device fixes toner on the recording material while conveying it.

In order to achieve the above-mentioned object, one aspect of the present invention provides a presser member, comprising: a first pad extending in a direction X; and a second pad extending in the direction X, juxtaposed to the first pad, and having hardness higher than the first pad, the first pad having a first nip forming surface which extends in the direction X, the second pad having a second nip forming surface which extends in the direction X and which is positioned in a direction Y intersecting the direction X with respect to the first nip forming surface, the first nip forming surface and the second nip forming surface being positioned on a same side of a direction Z intersecting the direction X and the direction Y, the first nip forming surface including a central portion which is positioned in a central section of the first pad in the direction X and end portions which are positioned in end sections of the first pad in the direction X, and an angle formed between each of the end portions of the first nip forming surface and the XZ plane being smaller than an angle formed between the central portion of the first nip forming surface and an XZ plane, wherein the XZ plane is formed on a side of the second nip forming surface side away from the first nip forming surface.

Herein, in the case where the end portion the first nip forming surface is a curved surface, "the angle formed between the end portion of the first nip forming surface and the XZ plane" is defined as an angle formed between a virtual plane and the XZ plane, where the virtual plane is formed to pass through both ends of the end portion in the direction Y. Similarly, in the case where when the central portion of the first nip forming surface is a curved surface, "an angle formed between the central portion of the first nip forming surface and the XZ plane" is defined as an angle formed between a virtual plane and the XZ plane, where the virtual plane is formed to pass through both ends of the central portion in the direction Y.

According to this aspect of the invention, the presser member is applied to a fixing device having a heating rotation unit and a pressure rotation unit which contact with each other to rotate together, and the presser member is placed inside the pressure rotation unit to press the pressure rotation unit toward the heating rotation unit.

Specifically, the first nip forming surface and the second nip forming surface contact with an inner surface of the pressure rotation unit to press the pressure rotation unit toward the heating rotation unit. A nip section is formed by contact between the pressure rotation unit and the heating rotation unit, and the nip section melts and fixes toner on a recording material while conveying the recording material.

In this case, the angle formed between the end portion of the first nip forming surface and the XZ plane is smaller than the angle formed between the central portion of the first nip forming surface and the XZ plane. Therefore, the angle formed by the end portion becomes smaller than the angle formed by the central portion with respect to the pressing direction of the pressure rotation unit pressed by the second nip forming surface (the pressing direction is generally parallel to the XZ plane).

Accordingly, in relation to the pressing force of the pressure rotation unit by using the presser member, a pressure allocation of the end portion of the first nip forming surface positioned in an end section of the presser member in the direction X becomes smaller than a pressure allocation of the central portion of the first nip forming surface positioned in the central section of the presser member in the direction X. On the other hand, a pressure allocation of the end portion of the second nip forming surface positioned in the end section of the presser member in the direction X becomes larger than a pressure allocation of the central portion of the second nip forming surface positioned in the central section of the presser member in the direction X.

Therefore, with respect to the distortion amount (elastic deformation amount) of the heating rotation unit caused by pressing force of the second nip forming surface, the distortion amount of the end section in a axial direction (i.e. the direction X) of the heating rotation unit becomes larger than the distortion amount of the central section of the heating rotation unit in the axial direction thereof, so that a circumferential velocity of the end section of the heating rotation unit becomes faster than a circumferential velocity of the central section of the heating rotation unit. Thus, a feed rate of the recording material by the end section of the heating rotation unit becomes faster than a feed rate of the recording material by the central section of the heating rotation unit.

Therefore, it becomes possible to suppress generation of wrinkles on a recording material when the fixing device fixes toner on the recording material while conveying it.

In the presser member according to one embodiment of the invention, the first nip forming surface has an edge positioned on an opposite side of the second nip forming surface in the direction Y, and the edge has a shape of a straight line extending in the direction X.

In the case where the presser member according to the embodiment is applied to the fixing device, the first nip forming surface is placed on an upstream side of the second nip forming surface in the rotation direction of the pressure rotation unit on the contact surface between the heating rotation unit and the pressure rotation unit. (This can be more easily understood by regarding the rotation direction of the pressure rotation unit on the contact surface between the heating roller and the pressure belt as a stream.)

In this case, the edge of the first nip forming surface is positioned upstream in the rotation direction of the pressure rotation unit. The edge of the first nip forming surface has a shape of a straight line extending in the direction X. Therefore, the edge of the first nip forming surface conforms (extends) to the axial direction of the heating rotation unit and the pressure rotation unit.

Thereby, as seen from the axial direction of the heating rotation unit and the pressure rotation unit, the edge of the first nip forming surface in the end portions and the central portion of the first nip forming surface is uniformly positioned with respect to the heating rotation unit and the pressure rotation unit at the entrance of the nip section.

This allows the width of the nip section in a recording material conveying direction to be made uniform along the axial direction of the heating rotation unit and the pressure rotation unit.

Therefore, regarding the pressure allocation of the first nip forming surface, it becomes possible to further ensure that the pressure allocation of the end portion is smaller than that of the central portion, while regarding the pressure allocation of the second nip forming surface, it becomes possible to further ensure that the pressure allocation of the end portion is larger than that of the central portion.

Thus, it becomes possible to further ensure that the feed rate of the recording material by the end section of the heating rotation unit is faster than the feed rate of the recording material by the central section of the heating rotation unit, and as the result, it becomes possible to more reliably suppress generation of wrinkles on the recording material.

In the presser member according to one embodiment of the invention, the end portions and the central portion of the first nip forming surface are uninterruptedly connected without level difference therebetween, and wherein an angle formed between each of the end portions of the first nip forming surface and the XZ plane is continuously decreased from the central section of the first pad in the direction X to the end section thereof in the direction X.

According to this aspect of the invention, in the case where the presser member is applied to the fixing device, the end portions and the central portion of the first nip forming surface are uninterruptedly connected without level difference therebetween, and an angle formed between the end portion of the first nip forming surface and the XZ plane is decreased continuously from the central section of the first pad in the direction X to the end sections thereof in the direction X. Therefore, rapid change in pressure distribution does not exist on the first nip forming surface in the axial direction of the heating rotation unit and the pressure rotation unit. This makes it possible to suppress uneven fixing such as gloss level difference.

Another aspect of the present invention provides a fixing device comprising: a heating rotation unit and a pressure rotation unit which contact with each other and rotate together; a heating section for heating the heating rotation unit; and the presser member as claimed in any one of claims 1 to 3, the presser member being placed inside the pressure rotation unit to press the pressure rotation unit toward the heating rotation unit, wherein the first nip forming surface is placed on an upstream side of the second nip forming surface in a rotation direction of the pressure rotation unit on a contact surface between the heating rotation unit and the pressure rotation unit, and in a cross section orthogonal to a axis of the heating rotation unit, an angle formed by each of the end portions of the first nip forming surface is smaller than an angle formed by the central portion of the first nip forming surface with respect to a pressing direction of the second nip forming surface pressing toward the heating rotation unit.

In the fixing device according to this aspect of the invention, in relation to the pressing force of the pressure rotation unit by the presser member, a pressure allocation of the end portion of the first nip forming surface positioned in an end section of the presser member in the direction X is smaller than a pressure allocation of the central portion of the first nip forming surface positioned in the central section of the presser member in the direction X, while a pressure allocation of the end portion of the second nip forming surface positioned in the end section of the presser member in the direction X is larger than a pressure allocation of the central portion of the second nip forming surface positioned in the central section of the presser member in the direction X. This is because, in a cross section orthogonal to the axis of the heating rotation unit, an angle formed by the end portion of the first nip forming surface is smaller than an angle formed by the central portion of the first nip forming surface with respect to a pressing direction of the second nip forming surface pressing toward the heating rotation unit.

Accordingly, with respect to the distortion amount (elastic deformation amount) of the heating rotation unit caused by pressing force of the second nip forming surface, the distortion amount of the end section of the heating rotation unit in the axial direction thereof (i.e. the direction X) becomes larger than the distortion amount of the central section of the heating rotation unit in the axial direction thereof. Therefore, a circumferential velocity of the end section of the heating rotation unit becomes faster than a circumferential velocity of the central section of the heating rotation unit. Thereby, a feed rate of the recording material by the end section of the heating rotation unit becomes faster than a feed rate of the recording material by the central section of the heating rotation unit.

Thus, it becomes possible to suppress generation of wrinkles on a recording material when the fixing device fixes toner on the recording material while conveying it.

Still another aspect of the present invention provides an image forming apparatus comprises the fixing device just previously stated.

The image forming apparatus includes the fixing device, so that so that the image forming apparatus can be implemented in high quality.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the present invention will be described in detail in conjunction with embodiments with reference to the drawings.

First Embodiment

Figure 1:
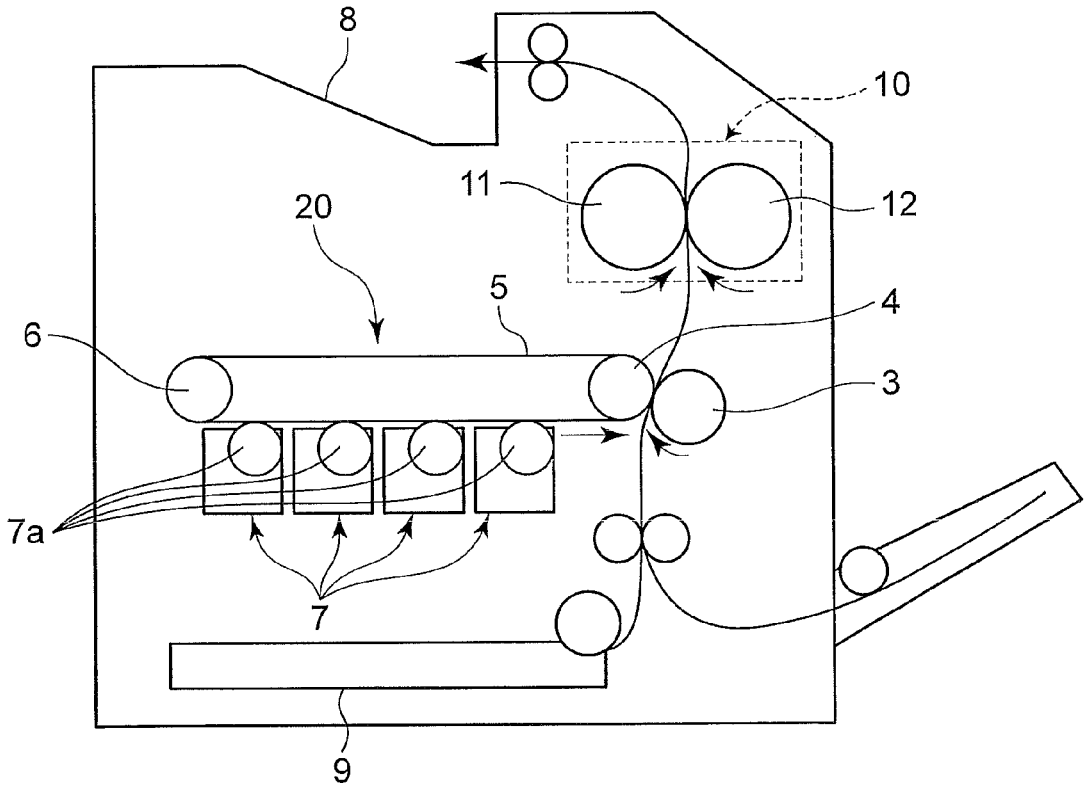
FIG. 1 shows a simplified structure view of an image forming apparatus according to one embodiment of the invention.

FIG. 1 shows a simplified structure view of an image forming apparatus according to a first embodiment of the present invention. The image forming apparatus is an electrophotographic color printer, and has an image forming device 20 and a fixing device 10.

The image forming device 20 attaches unfixed toner onto a recording material to form an image. The fixing device 10 melts toner and fixes it to a recording material.

The image forming device 20 has a transfer belt 5, four image forming units 7 placed along the transfer belt 5, and a transfer roller 3 placed to face the transfer belt 5.

The transfer belt 5 is wound around a first support roller 4 and a second support roller 6. The image forming units 7 form toner images and transfers the toner images onto the transfer belt 5. The transfer roller 3 then transfers the toner images, which have been transferred onto the transfer belt 5, onto a recording material.

An image forming unit 7 for forming a black (K) toner image, an image forming unit 7 for forming a yellow (Y) toner image, an image forming unit 7 for forming a magenta (M) toner image, and an image forming unit 7 for forming a cyan (C) toner image are placed in this order along from upstream to downstream of the transfer belt 5.

Each of the image forming units 7 has a photoconductor drum 7*a*, a charging section (unshown), an exposure section (unshown) and a developing section (unshown).

The charging section electrically charges the photoconductor drum 7*a* with uniformity. The exposure section performs image exposure on the charged photoconductor drum 7*a*. The developing section develops an electrostatic latent image formed by exposure with use of the toner of respective colors.

The fixing device 10 has a heating roller 11 as a heating rotation unit, and a pressure belt 12 as a pressure rotation unit. The heating roller 11 and the pressure belt rotate together in mutual contact of their outer circumferential surfaces. The heating roller 11 and the pressure belt 12 make the toner on the recording material P fixed, while carrying the recording material P in their mutual contact.

Next, operations of the image forming apparatus are explained.

A toner image is developed on each of the photoconductor drums 7*a* of the image forming units 7, and the toner image is primarily transferred onto the transfer belt 5 at a contact location with the transfer belt 5.

Whenever the transfer belt 5 passes each of the image forming units 7, the colored toner image transferred onto the transfer belt 5 is laid on previous colored toner image, resulting in a full color toner image formed on the transfer belt 5.

Then, the full color toner image on the transfer belt 5 is secondarily transferred as a whole onto a recording material by using the transfer roller 3 located in the downstream of the transfer belt 5.

The recording material then passes the fixing device 10 positioned in the downstream of a conveying path of the recording material. Thereby, the toner image is fixed on the recording material, and then the recording material is discharged onto a paper output tray 8.

The recording material is stored in a cassette 9 located at a lowermost portion of the printer. The recording material is conveyed one by one from the cassette 9 to the transfer roller 3.

Figure 2:
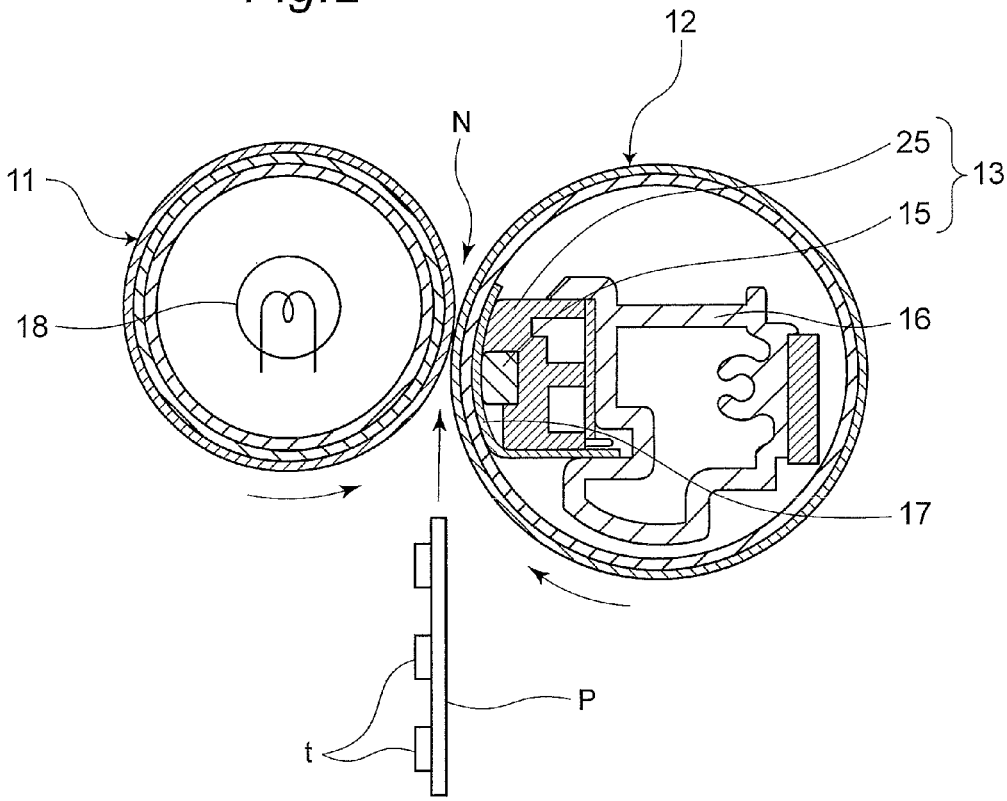
FIG. 2 shows a cross sectional view of a fixing device according to one embodiment of the invention.

FIG. 2 shows a simplified structural view of the fixing device according to one embodiment of the invention. This fixing device has a heating roller 11 as a heating rotation unit, a pressure belt 12 as a pressure rotation unit, a heater 18 as a heating section, and a presser member 13. The heating roller 11 and the pressure belt 12 rotate together in mutual contact of their outer circumferential surfaces. The heater 18 is for heating the heating roller 11. The presser member 13 is placed inside the pressure belt 12 to press the pressure belt 12 toward the heating roller 11.

The presser member 13 has a first pad (elastic pad) 15 and a second pad (rigid pad) 25 whose hardness is higher than that of the first pad 15.

The first pad 15 and the second pad 25 are formed to have about the same lengths as those (widths) of the heating roller 11 and the pressure belt 12 along the axial direction of the heating roller 11 or the pressure belt 12.

The second pad 25 is juxtaposed to the first pad 15. The first pad 15 is attached to the second pad 25, and the second pad 25 is attached to a holding frame 16.

The first pad 15 presses the pressure belt 12 toward the heating roller 11 while the first pad 15 is elastically deformed. The second pad 25 presses the pressure belt 12 toward the heating roller 11 on a downstream side of the first pad 15 in the rotation direction of the pressure belt 12 on a contact surface between the heating roller 11 and the pressure belt 12.

The heating roller 11 is rotated by an unshown motor or other driving section. The pressure belt 12 rotates following after rotation of the heating roller 11 by friction with the heating roller 11.

Then, the heating roller 11 and the pressure belt 12 contact with each other to carry the recording material and make toner t of the recording material P fixed. Specifically, the toner t on the recording material P is fused and fixed by a nip portion N, the recording material P is carried through the nip portion N which is formed by mutual contact of the heating roller 11 and the pressure belt 12.

By pressure with elastic-deformation of the first pad 15, the toner t is successfully fixed to the recording material P. By pressure of the second pad 25, the heating roller 11 is distorted to lower contact power between the recording material P and the heating roller 11, so that the recording material P can be easily separated off.

The recording material P is a sheet such as paper sheet, OHP sheet or the like. Toner t is deposited on one surface of the recording material P. The toner t is made from a material having heat-fusibility such as resin, magnetic material or coloring matter.

The heating roller 11 comes into contact with one surface (image surface) of the recording material P. The heating roller 11 is a hollow roller. The heating roller has an inner cylinder, an intermediate layer and a surface layer in this order from inside to outside. The outer diameter of the heating roller 11 is desirably 20 to 50 mm for example.

The surface layer is preferably formed by a component having releasability such as fluoride tube, fluorine coating or the like. Thickness of the surface layer is 5 to 100 μm. The intermediate layer 52 is an elastic layer. The intermediate layer 52 is preferably made of a material having high heat resistance such as silicone rubber, fluororubber or the like. The intermediate layer 52 has a thickness of 0.05 to 5 mm. The inner cylinder is preferably made of metal such as aluminum or iron. Its thickness is 0.1 to 5 mm.

The pressure belt 12 has a base layer and a surface layer in this order from inside to outside. The outer diameter of the pressure belt 12 is preferably 20 to 100 mm, for example. The surface layer is preferably formed by a component having releasability such as fluoride tubes, fluorine coatings, or the like. The surface layer may also have electrical conductivity. Thickness of the surface layer is 5 to 100 μm. In consideration of thermal resistance, strength, surface smoothness or the like, the base layer may be made of heat-resistant resin such as polyimide, polyimide or polyimidoamide, or may be made of metal such as aluminum, stainless steel or nickel A sliding contact member 17 is placed between the pressure belt 12 and the presser member 13. The sliding contact member 17 slides on the inner surface of the rotating pressure belt 12. The sliding contact member 17 has a sheet shape. The sliding contact member 17 is fixed to the holding frame 16 and covers the presser member 13.

Figure 3:
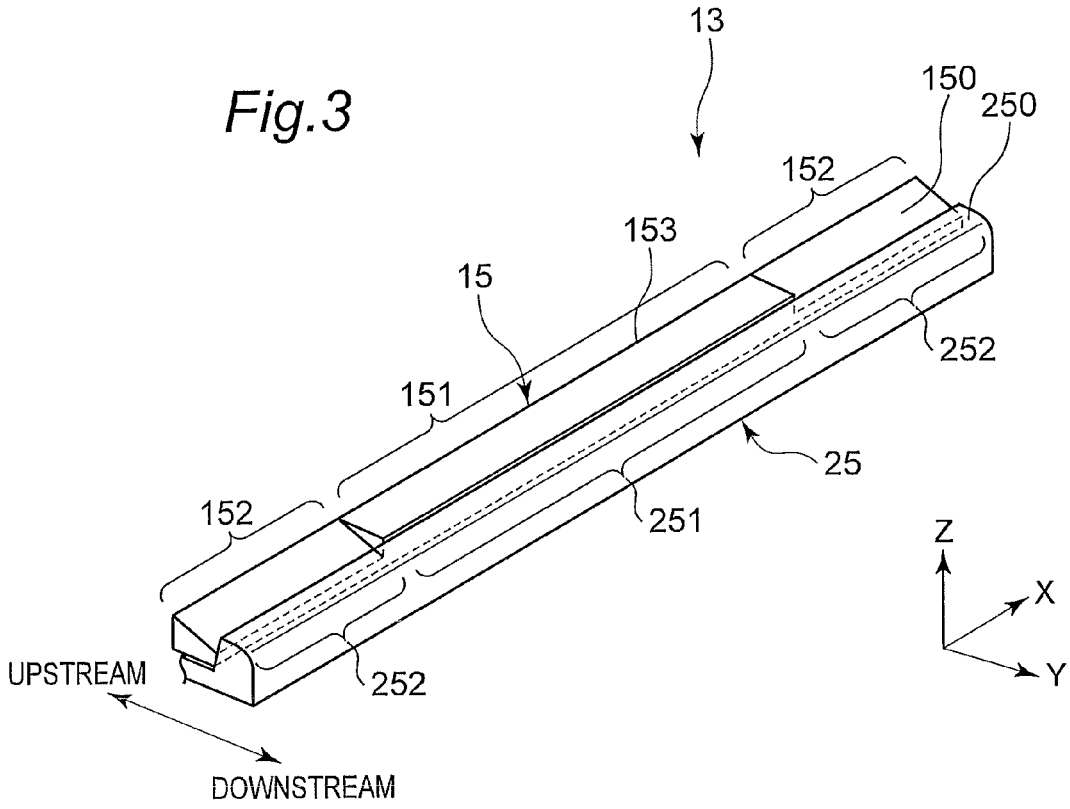
FIG. 3 shows a perspective view of a presser member according to one embodiment of the invention.

As shown in FIG. 3, both of the first pad 15 and the second pad 25 extend in the direction X. The direction X conforms to the axial directions of the heating roller 11 and the pressure belt 12.

The first pad 15 is preferably made of a material having elasticity and high heat resistance, such as silicon rubber, fluorine rubber or the like. The thickness of the first pad 15 is preferably about 0.1 to 10 mm, for example. The hardness of the first pad 15 is preferably ASKER C hardness 15 to 30, for example. The first pad 15 may be integrated with a plate of metal such as stainless steel, aluminum or iron in consideration of assemblability, productivity and the like.

The second pad 25 is made of resins such as polyphenylene sulfide, polyimide, liquid crystal polymer, or the like, or metal such as aluminum, iron, stainless steel or the like, or ceramics.

The first pad 15 has a first nip forming surface 150 which extends in the direction X. The second pad 25 has a second nip forming surface 250 which extends in the direction X.

The first nip forming surface 150 and the second nip forming surface 250 come into contact with an inner surface of the pressure belt 12 through the sliding contact member 17 to press the pressure belt 12 toward the heating roller 11, and a nip section N is formed by the contact between the heating roller 11 and the pressure belt 12.

The second nip forming surface 250 is positioned in the direction Y which intersects the direction X with respect to the first nip forming surface 150. The direction Y conforms to a rotation direction of the pressure belt 12 on the contact surface between the heating roller 11 and the pressure belt 12. In other words, the direction Y conforms to a conveying direction of the recording material P in the nip section N. The first nip forming surface 150 is placed on an upstream side of the second nip forming surface 250 in the rotation direction of the pressure belt 12 on the contact surface between the heating roller 11 and the pressure belt 12. The direction X and the direction Y are orthogonal to each other.

The first nip forming surface 150 and the second nip forming surface 250 are positioned on the same side of a direction Z which intersects the direction X and the direction Y. The direction Z generally conforms to the pressing direction of the pressure belt 12 pressed by the second nip forming surface 250.

The first nip forming surface 150 includes a central portion 151 which is positioned in a central section of the first pad 15 in the direction X, and end portions 152 which are positioned in end sections of the first pad 15 in the direction X.

The second nip forming surface 250 includes a central portion 251 which is positioned in a central section of the second pad 25 in the direction X, and end portions 252 which are positioned in end sections of the second pad 25 in the direction X.

The central portion 151 of the first nip forming surface 150 positionally corresponds to the central portion 251 of the second nip forming surface 250. The end portions 152 of the first nip forming surface 150 positionally corresponds to the end portions 252 of the second nip forming surface 250.

The first nip forming surface 150 has an edge 153 which is positioned on an opposite side of the second nip forming surface 250 in the direction Y. In short, the edge 153 is positioned upstream in the rotation direction of the pressure belt 12.

The edge 153 has is a shape of a straight line extending in the direction X. In other words, the edge 153 lies in the axial direction of the heating roller 11 and the pressure belt 12.

Figure 4:
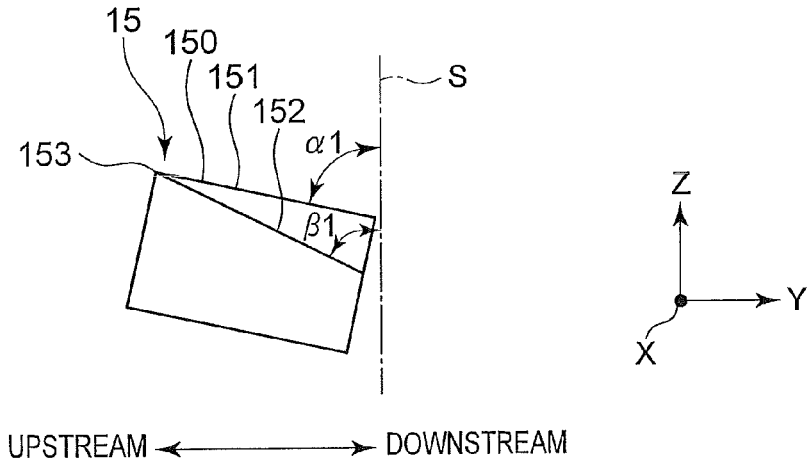
FIG. 4 shows a side view of a first pad as seen from a direction X indicated in FIG. 3.

As shown in FIG. 4, in the case where an XZ plane S is formed on a side of the second nip forming surface 250 (on the downstream side) away from the first nip forming surface 150, an angle $\beta 1$ is smaller than an angle $\alpha 1$. The angle $\beta 1$ is formed between the XZ plane S and the end portion 152 of the first nip forming surface 150. The angle $\alpha 1$ is formed between the XZ plane S and the central portion 151 of the first nip forming surface 150. In the first nip forming surface 150, there is a level difference between the central portion 151 and the end portion 152.

It is to be noted that an angle formed between the end portion 252 of the second nip forming surface 250 and the XZ plane S is identical to an angle formed between the central portion 251 of the second nip forming surface 250 and the XZ plane S. The end portion 252 and the central portion 251 in the second nip forming surface 250 are uniformly smooth.

Figure 5A:
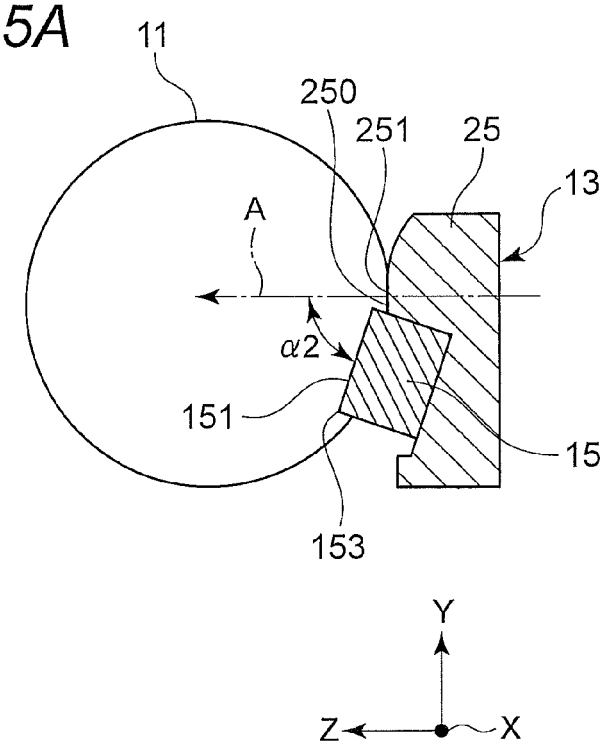
FIG. 5A shows a view of a central section of the presser member in the direction X for explaining operation of the presser member.
Figure 5B:
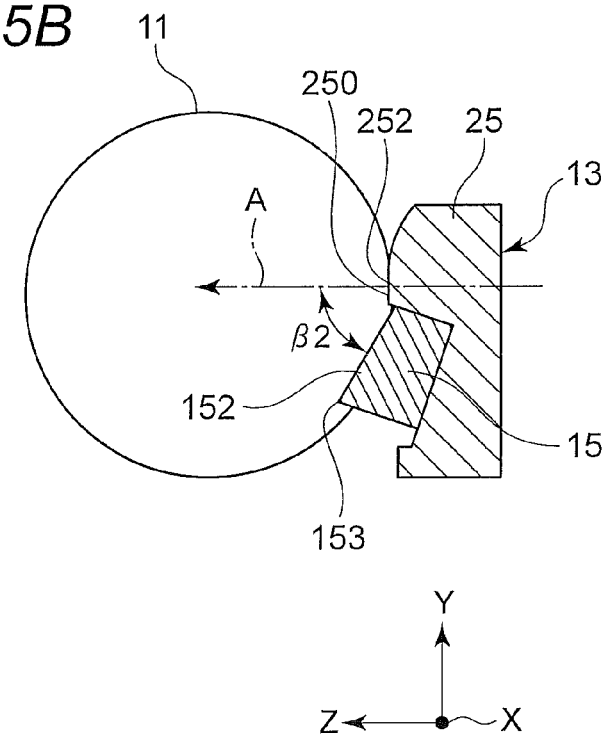
FIG. 5B shows a view of an end section of the presser member in the direction X for explaining operation of the presser member.

FIG. 5A is a cross sectional view of the central section of the presser member 13 extending in the direction X. FIG. 5B is a cross sectional view of the end section of the presser member 13 extending in the direction X. In the cross sections orthogonal to the axes of the heating rollers 11 shown in FIGS. 5A and 5B, a pressing direction (A) of the end portion 252 of the second nip forming surface 250 pressing toward the heating roller 11 is identical to a pressing direction (A) of the central portion 251 of the second nip forming surface 250 pressing toward the heating roller 11. The pressing direction A is generally parallel to the XZ plane S.

In the cross sections orthogonal to the axes of the heating rollers 11 shown in FIGS. 5A and 5B, an angle $\beta 2$ is smaller than an angle $\alpha 2$. Therein, the angle $\beta 2$ is formed by the end portion 152 of the first nip forming surface 150 with respect to the pressing direction A. The angle $\alpha 2$ is formed by the central portion 151 of the first nip forming surface 150 with respect to the pressing direction A.

Accordingly, as to pressing forces of the presser member 13 toward the pressure belt 12, a pressure allocation to the end portion 152 of the first nip forming surface 150 is smaller than that to the central portion 151 of the first nip forming surface 150. Therein, the end portion 152 is positioned in the end section of the presser member 13, and the central portion 151 is positioned in the central section of the presser member 13 in the direction X, as stated above. Meanwhile, a pressure allocation to the end portion 252 of the second nip forming surface 250 is larger than that to the central portion 251 of the second nip forming surface 250. Therein, the end portion 252 is positioned in the end section of the presser member 13, and the central portion 251 is positioned in the central section of the presser member 13 in the direction X, as stated above.

Figure 6:
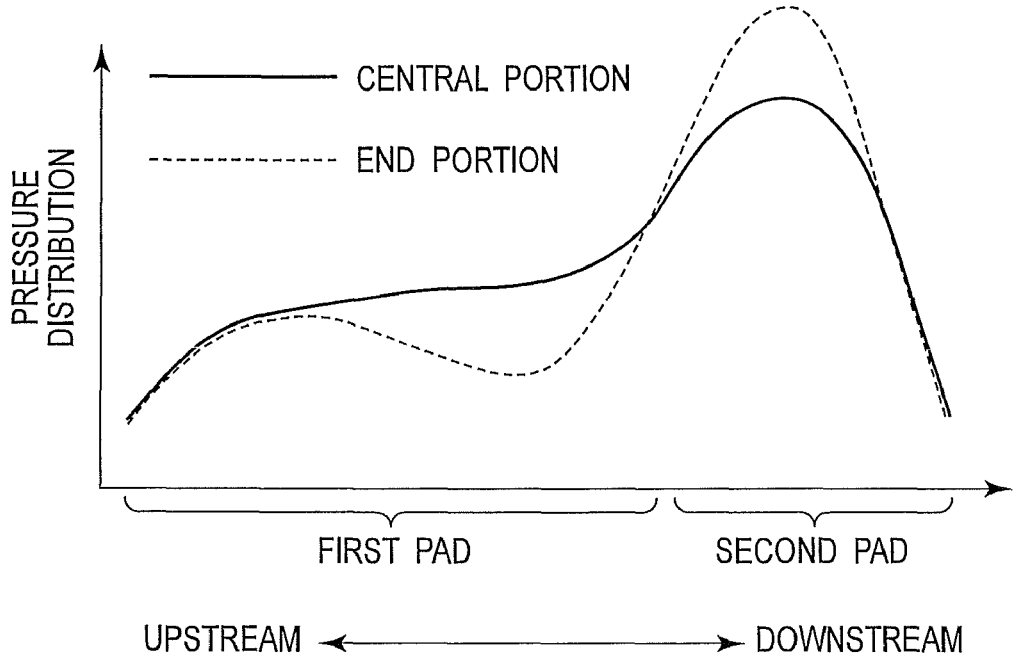
FIG. 6 shows a pressure distribution graph of the first pad and a second pad.

That is to say, as shown in FIG. 6, in the first pad, the pressure distribution of the downstream side of the end portion shown by a dotted line is smaller than the pressure distribution of the downstream side of the central portion shown by a solid line. On the other hand, in the second pad, the pressure distribution of the downstream side of the end portion shown by a dotted line is larger than the pressure distribution of the downstream side of the central portion shown by a solid line.

As the result, with respect to the distortion amount (elastic deformation amount) of the heating roller 11 caused by the pressing force of the second nip forming surface 250, the distortion amount in the end section of the heating roller 11 in the axial direction thereof is larger than the distortion amount of the axially central section of the heating roller 11.

In other words, the heating roller 11 has the elastic intermediate layer, and the pressing force of the end portion 252 of the second nip forming surface 250 is larger than the pressing force of the central portion 251 of the second nip forming surface 250. Therefore, the elastic deformation amount of the end section of the heating roller 11 in the axial direction thereof becomes large rather than the elastic deformation amount of the axially central section of the heating roller 11.

This makes a circumferential length in the axial end section of the heating roller 11 longer than a circumferential length in the axially central section of the heating roller 11. As the result, a circumferential velocity in the end section of the heating roller 11 becomes faster than a circumferential velocity in the central section of the heating roller 11. Thereby, a feed rate of the recording material by the axial end section of the heating roller 11 becomes faster than a feed rate of the recording material by the axially central section of the heating roller 11.

This is opposite to the case of the conventional fixing device as stated at the beginning. Thus, it becomes possible to suppress generation of wrinkles on a recording material while the recording material is conveyed and fixed by the fixing device.

The edge 153 of the first nip forming surface 150 shown in FIGS. 5A and 5B has a shape of a straight line extending in the direction X, so that the edge 153 is along both the axial direction (direction X) of the heating roller 11 and the pressure belt 12.

Accordingly, as seen from the axial direction of the heating roller 11 or the pressure belt 12, the edge 153 of the first nip forming surface 150 in the axial end portions 152 and the axially central portion 151 is uniformly positioned with respect to the heating roller 11 and the pressure belt 12 located around the nip section N.

This allows the width of the nip section N in a recording material conveying direction to be made uniform along the axial direction of the heating roller 11 and the pressure belt 12.

Therefore, regarding the pressure allocation of the first nip forming surface 150, it becomes possible to further ensure that the pressure allocation of the end portion 152 is smaller than that of the central portion 151. On the other hand, regarding the pressure allocation of the second nip forming surface 250, it becomes possible to further ensure that the pressure allocation of the end portion 252 is larger than that of the central portion 251.

Therefore, it becomes possible to further ensure that the feed rate of the recording material by the end section of the heating roller 11 is faster than the feed rate of the recording material by the central section of the heating roller 11. As the result, it becomes possible to more reliably suppress generating of wrinkles on the recording material.

The image forming apparatus includes the above-structured fixing device, so that the image forming apparatus can be implemented in high quality.

Second Embodiment

Figure 7:
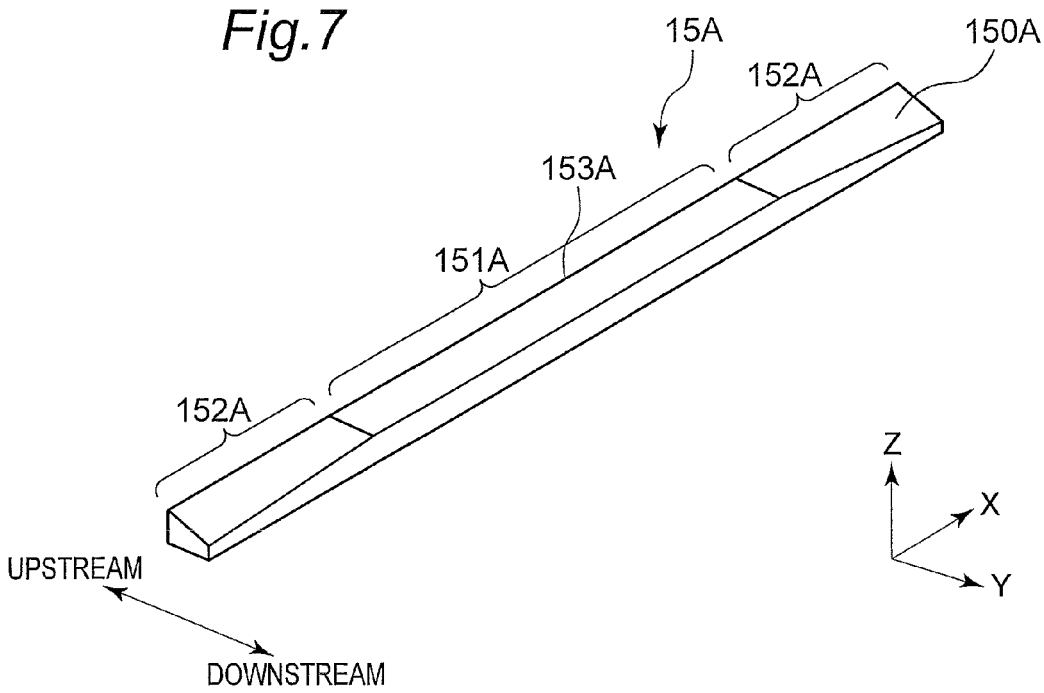
FIG. 7 shows a perspective view of a presser member according to another embodiment of the invention.

FIG. 7 shows a fixing device according to a second embodiment of the invention. The second embodiment is different from the first embodiment in the structure of the first pad.

In a first pad 15A, as shown in FIG. 7, an angle formed between an end portion 152A of a first nip forming surface 150A and an XZ plane S (see FIG. 4) is smaller than an angle formed between a central portion 151A of a first nip forming surface 150A and the XZ plane S. An upstream side edge 153A has a shape of a straight line extending in the direction X.

The end portions 152A and the central portion 151A of the first nip forming surface 150A are uninterruptedly connected without any level difference therebetween.

The angle formed between the end portion 152A of the first nip forming surface 150A and the XZ plane S is continuously decreased from the central section of the first pad 15A in the direction X to the end section of the first pad 15A in the direction X.

Accordingly, the first nip forming surface 150A has no rapid change in pressure distribution in the axial direction of the heating roller 11 and pressure belt 12. This makes it possible to suppress uneven fixing such as gloss level difference.

Figure 8:
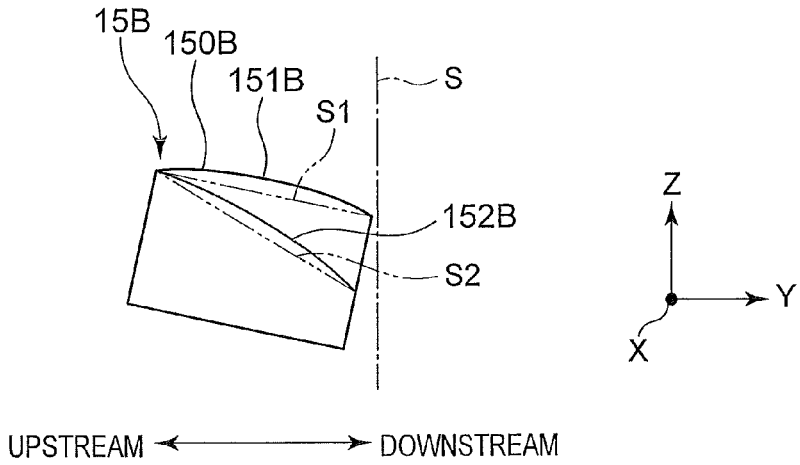
FIG. 8 shows a side view of a presser member according to still another embodiment of the invention.

The present invention shall not be limited to the above-disclosed embodiments. As shown in FIG. 8, for example, a central portion 151B and an end portion 152B of a first nip forming surface 150B in first pad 15B are protruding curves.

In this case, "an angle formed between the central portion 151B of the first nip forming surface 150B and the XZ plane S" is defined as an angle formed between a virtual plane S1 and the XZ plane S, wherein sides of the virtual plane S1 are formed to pass through both ends of the central portion 151B in the direction Y. Similarly, "an angle formed between an end portion 152B of the first nip forming surface 150B and the XZ plane S" is defined as an angle formed between a virtual plane S2 and the XZ plane S, wherein sides of the virtual plane S2 are formed to pass through both ends of the end portion 152B in the direction Y. It is to be noted that the central portion 151B and the end portion 152B may be formed with any combination of shape types such as a plane, a protruding curve, a recess curve and the like.

Also, as the heating rotation unit, an endless belt may be used instead of the heating roller 11. Further, the heater 18 may be positioned outside the heating roller 11.

And also, the image forming apparatus may be any one of monochrome/color copiers, printers, facsimiles, multi-function machines of these functions and the like.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

The invention claimed is:

1. A presser member, comprising:

a first pad extending in a direction X; and a second pad extending in the direction X, juxtaposed to the first pad, and having hardness higher than the first pad, the first pad having a first nip forming surface which extends in the direction X, the second pad having a second nip forming surface which extends in the direction X and which is positioned in a direction Y intersecting the direction X with respect to the first nip forming surface, the first nip forming surface and the second nip forming surface being positioned on a same side of a direction Z intersecting the direction X and the direction Y, the first nip forming surface including a central portion which is positioned in a central section of the first pad in the direction X and end portions which are positioned in end sections of the first pad in the direction X, and an angle formed between each of the end portions of the first nip forming surface and the XZ plane being smaller than an angle formed between the central portion of the first nip forming surface and an XZ plane, wherein the XZ plane is formed on a side of the second nip forming surface side away from the first nip forming surface.

2. The presser member as claimed in claim 1, wherein the first nip forming surface has an edge positioned on an opposite side of the second nip forming surface in the direction Y, and the edge has a shape of a straight line extending in the direction X.

3. The presser member as claimed in claim 2, wherein the end portions and the central portion of the first nip forming surface are uninterruptedly connected without level difference therebetween, and wherein an angle formed between each of the end portions of the first nip forming surface and the XZ plane is continuously decreased from the central section of the first pad in the direction X to the end section thereof in the direction X.

4. The presser member as claimed in claim 1, wherein the end portions and the central portion of the first nip forming surface are uninterruptedly connected without level difference therebetween, and wherein an angle formed between each of the end portions of the first nip forming surface and the XZ plane is continuously decreased from the central section of the first pad in the direction X to the end section thereof in the direction X.

5. A fixing device comprising:

a heating rotation unit and a pressure rotation unit which contact with each other and rotate together;

a heating section for heating the heating rotation unit; and a presser member having:

a first pad extending in a direction X; and a second pad extending in the direction X, juxtaposed to the first pad, and having hardness higher than the first pad, the first pad having a first nip forming surface which extends in the direction X, the second pad having a second nip forming surface which extends in the direction X and which is positioned in a direction Y intersecting the direction X with respect to the first nip forming surface, the first nip forming surface and the second nip forming surface being positioned on a same side of a direction Z intersecting the direction X and the direction Y, the first nip forming surface including a central portion which is positioned in a central section of the first pad in the direction X and end portions which are positioned in end sections of the first pad in the direction X, and an angle formed between each of the end portions of the first nip forming surface and the XZ plane being smaller than an angle formed between the central portion of the first nip forming surface and an XZ plane, wherein the XZ plane is formed on a side of the second nip forming surface side away from the first nip forming surface, and wherein the presser member is placed inside the pressure rotation unit to press the pressure rotation unit toward the heating rotation unit, the first nip forming surface is placed on an upstream side of the second nip forming surface in a rotation direction of the pressure rotation unit on a contact surface between the heating rotation unit and the pressure rotation unit, and in a cross section orthogonal to a axis of the heating rotation unit, an angle formed by each of the end portions of the first nip forming surface is smaller than an angle formed by the central portion of the first nip forming surface with respect to a pressing direction of the second nip forming surface pressing toward the heating rotation unit.

6. An image forming apparatus comprising a fixing device including:

a heating rotation unit and a pressure rotation unit which contact with each other and rotate together;

a heating section for heating the heating rotation unit; and a presser member having:

a first pad extending in a direction X; and a second pad extending in the direction X, juxtaposed to the first pad, and having hardness higher than the first pad, the first pad having a first nip forming surface which extends in the direction X, the second pad having a second nip forming surface which extends in the direction X and which is positioned in a direction Y intersecting the direction X with respect to the first nip forming surface, the first nip forming surface and the second nip forming surface being positioned on a same side of a direction Z intersecting the direction X and the direction Y, the first nip forming surface including a central portion which is positioned in a central section of the first pad in the direction X and end portions which are positioned in end sections of the first pad in the direction X, and an angle formed between each of the end portions of the first nip forming surface and the XZ plane being smaller than an angle formed between the central portion of the first nip forming surface and an XZ plane, wherein the XZ plane is formed on a side of the second nip forming surface side away from the first nip forming surface, and wherein the presser member is placed inside the pressure rotation unit to press the pressure rotation unit toward the heating rotation unit, the first nip forming surface is placed on an upstream side of the second nip forming surface in a rotation direction of the pressure rotation unit on a contact surface between the heating rotation unit and the pressure rotation unit, and in a cross section orthogonal to a axis of the heating rotation unit, an angle formed by each of the end portions of the first nip forming surface is smaller than an angle formed by the central portion of the first nip forming surface with respect to a pressing direction of the second nip forming surface pressing toward the heating rotation unit.

* * * * *